US010042284B2

(12) United States Patent
Hayami

(10) Patent No.: US 10,042,284 B2
(45) Date of Patent: Aug. 7, 2018

(54) ELECTROPHOTOGRAPHIC IMAGE FORMING APPARATUS AND ELECTROPHOTOGRAPHIC IMAGE FORMING METHOD

(71) Applicant: KONICA MINOLTA, INC., Chiyoda-ku, Tokyo (JP)

(72) Inventor: Toshiki Hayami, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/641,452

(22) Filed: Jul. 5, 2017

(65) Prior Publication Data

US 2018/0017902 A1 Jan. 18, 2018

(30) Foreign Application Priority Data

Jul. 13, 2016 (JP) ..... 2016-138150

(51) Int. Cl.
*G03G 15/08* (2006.01)
*G03G 15/16* (2006.01)
(Continued)

(52) U.S. Cl.
CPC ..... *G03G 15/0844* (2013.01); *G03G 15/0105* (2013.01); *G03G 15/0194* (2013.01);
(Continued)

(58) Field of Classification Search
CPC ..... G03G 15/0844; G03G 15/0877; G03G 15/1605; G03G 15/161; G03G 15/162;
(Continued)

(56) References Cited

U.S. PATENT DOCUMENTS 9,891,552 B2 * 2/2018 Suzumi ..... G03G 15/0822
2005/0185975 A1 * 8/2005 Kobayashi ..... G03G 15/0844 399/44

(Continued)

FOREIGN PATENT DOCUMENTS

JP 2000-206801 A 7/2000
JP 2003-076079 A 3/2003

(Continued)

*Primary Examiner* — Carla Therrien
(74) *Attorney, Agent, or Firm* — Buchanan Ingersoll & Rooney PC

(57) ABSTRACT

An electrophotographic image forming apparatus includes: an electrostatic latent image retainer; an intermediate transfer body; a primary transfer member to transfer toner image retained by the electrostatic latent image retainer to an imaging region of the intermediate transfer body; a secondary transfer member to transfer the transferred toner image from the intermediate transfer body to a transfer medium; a toner forcible discharger to forcibly discharge toner into a non-imaging region of the intermediate transfer body; and a controller to control a volume of the toner to be forcibly discharged. The intermediate transfer body is a multi-layer belt including a base layer and an outermost coating layer. The coating layer contains silicon dioxide. The controller reduces the volume of the toner to be forcibly discharged based on use history information of the intermediate transfer body, compared to the volume at an initial stage of use.

9 Claims, 8 Drawing Sheets

(51) Int. Cl.
*G03G 15/01* (2006.01)
*G03G 21/16* (2006.01)
*G03G 15/00* (2006.01)

(52) U.S. Cl.
CPC ..... *G03G 15/0877* (2013.01); *G03G 15/1605* (2013.01); *G03G 15/50* (2013.01); *G03G 21/1647* (2013.01)

(58) Field of Classification Search
CPC ..... G03G 15/0105; G03G 15/0194; G03G 15/50; G03G 21/1647
See application file for complete search history.

(56) References Cited

U.S. PATENT DOCUMENTS

| | | | | |
|---|---|---|---|---|
| 2011/0206422 | A1 | 8/2011 | Hirose et al. | |
| 2016/0170357 | A1* | 6/2016 | Saito | G03G 15/0844 399/27 |
| 2016/0370747 | A1* | 12/2016 | Kawasaki | G03G 15/553 |

FOREIGN PATENT DOCUMENTS

| | | | |
|---|---|---|---|
| JP | 2011-257586 | A | 12/2011 |
| JP | 2014-109586 | A | 6/2014 |
| WO | WO 2009/145173 | A1 | 12/2009 |

* cited by examiner

ELECTROPHOTOGRAPHIC IMAGE FORMING APPARATUS AND ELECTROPHOTOGRAPHIC IMAGE FORMING METHOD

CROSS-REFERENCE TO RELATED APPLICATIONS

The present U.S. patent application claims a priority under the Paris Convention of Japanese Patent Application No. 2016-138150 filed on Jul. 13, 2016, the entirety of which is incorporated herein by references.

BACKGROUND

Technical Field

The present invention relates to an electrophotographic image forming apparatus and an electrophotographic image forming method, in particular, an electrophotographic image forming apparatus that has stable secondary transfer characteristics with low toner consumption, and an electrophotographic image forming method that can achieve these characteristics.

Description of the Related Art

Some traditional schemes of forming an electrophotographic image use belt-like intermediate transfer bodies. In such a scheme, a toner image formed on an electrostatic latent image retainer (hereinafter also referred to as "electrophotographic photoreceptor" or simply "photoreceptor") is transferred to a transfer medium (e.g., a sheet) with the intermediate transfer body.

This scheme involves two transfers, i.e., a primary transfer of a toner image from the electrophotographic photoreceptor to the intermediate transfer body, and a secondary transfer of the toner image from the intermediate transfer body to the transfer medium. The intermediate transfer scheme is mainly used in formation of full-color images, which indicates formation of images with multiple toners, such as black, cyan, magenta, and yellow toners. In detail, toner images in different colors are formed on the respective photoreceptors and then sequentially transferred to the intermediate transfer body in the primary transfer, so that they are superimposed into a full-color toner image. This full-color toner image is then transferred to a transfer medium in the secondary transfer, to thereby yield a full-color printed product.

Requirements for the intermediate transfer body are sufficient toner transfer characteristics from the electrophotographic photoreceptors to the intermediate transfer body and from the intermediate transfer body to the transfer medium, good cleaning characteristics of removing the residual toner after the transfers, and high surface durability against repeated cycles of transfer of the toner images and removal of the residual toner.

In order to improve the toner transfer characteristics from the intermediate transfer body to the transfer medium (hereinafter also referred to as "secondary transfer characteristics"), traditional single-layer intermediate transfer belts are composed of, for example, polyimide to increase the surface hardness. Such intermediate transfer belts having high surface hardness do not allow toner to tightly adhere to their surfaces. This feature probably accounts for the improvement in the secondary transfer characteristics.

In order to reduce the adhesion of toner onto the surfaces of the intermediate transfer belts as the intermediate transfer bodies, each belt can have a coating layer at the outermost surface. A typical coating layer contains silicon oxide as an inorganic material (for example, refer to Patent Literatures 1 to 4: Japanese Patent Application Laid-Open Publication No. 2014-109586; Japanese Patent Application Laid-Open Publication No. 2000-206801; Japanese Patent Application Laid-Open Publication No. 2011-257586; WO2009/145173; and Japanese Patent Application Laid-Open Publication No. 2003-76079). Patent Literature 1 discloses a coating layer that includes a silicon-oxide film containing a certain level of carbon and can thereby improve the secondary transfer characteristics and durability.

The electrophotographic image forming apparatuses have recently been required to accept a variety of transfer media, not only plain paper and OA paper but also thick paper, coated paper, and paper having uneven surfaces (hereinafter referred to as "uneven sheets"). In particular, uneven sheets provided with special textures thereon by embossing processes have been preferred for business cards and the front covers of printed products.

Unfortunately, continuous printing on uneven sheets significantly impairs the secondary transfer characteristics of the intermediate transfer body having a base layer and a surface coating layer containing silicon dioxide.

In general, agitation of a developer in a container in a low toner consumption state, for example, during continuous printing of images having a small coverage rate, leads to various troubles, such as scumming, toner scattering, poor transfer, non-uniform density, and scumming due to refilled toner. In order to avoid these troubles and to improve the secondary transfer characteristics, the toner can be forcibly consumed at predetermined timings. This scheme consumes a large amount of toner in despite of stable secondary transfer characteristics.

SUMMARY

An object of the present invention, which has been accomplished to solve the above-described problems, is to provide an electrophotographic image forming apparatus that has stable secondary transfer characteristics with low toner consumption, and provide an electrophotographic image forming method that can achieve these characteristics.

The present inventors have investigated the causes of the problems to seek a solution and found that in the case of the intermediate transfer body having the coating layer containing silicon dioxide, if the coating layer is thinned due to abrasion, the belt can provide sufficient secondary transfer characteristics regardless of a reduced volume of the toner to be forcibly discharged, in addition to the traditional knowledge of protecting toner through forcible discharge of a certain volume of toner regardless of the coverage rate. This finding has conducted the present invention.

The object of the present invention is thus accomplished by the following means.

According to a first aspect of the present invention, an electrophotographic image forming apparatus reflecting one aspect of the present invention includes: an electrostatic latent image retainer; an intermediate transfer body; a primary transfer member to execute a primary transfer of toner image retained by the electrostatic latent image retainer to an imaging region of the intermediate transfer body; a secondary transfer member to execute a secondary transfer of the toner image transferred in the primary transfer by the primary transfer member from the intermediate transfer body to a transfer medium; a toner forcible discharger to forcibly discharge toner into a non-imaging region of the intermediate transfer body; and a controller to control a volume of the toner to be forcibly discharged by the toner forcible discharger. The intermediate transfer body is a multi-layer belt including a base layer and an outermost coating layer. The coating layer contains silicon dioxide. The controller performs control to reduce the volume of the toner to be forcibly discharged based on use history information of the intermediate transfer body, compared to the volume of the toner to be forcibly discharged at an initial stage of use of the intermediate transfer body.

According to a second aspect of the present invention, a method for forming an electrophotographic image from a toner image, the method reflecting another aspect of the present invention, includes: primarily transferring the toner image retained by an electrostatic latent image retainer to an imaging region of an intermediate transfer body; secondarily transferring the toner image transferred in the primarily transferring from the intermediate transfer body to a transfer medium; and forcibly discharging toner to a non-imaging region of the intermediate transfer body. The intermediate transfer body is a multi-layer belt including a base layer and an outermost coating layer. The coating layer contains silicon dioxide. A volume of the toner to be forcibly discharged to the non-imaging region is reduced by a controller based on use history information of the intermediate transfer body, compared to the volume of the toner to be forcibly discharged at an initial stage of use of the intermediate transfer body.

BRIEF DESCRIPTION OF THE DRAWING

The advantages and features provided by one or more embodiments of the invention will become more fully understand from the detailed description given hereinbelow and the appended drawings which are given by way of illustration only, and thus are not intended as a definition of the limits of the present invention, and wherein.

DETAILED DESCRIPTION OF EMBODIMENTS

Figure 1:
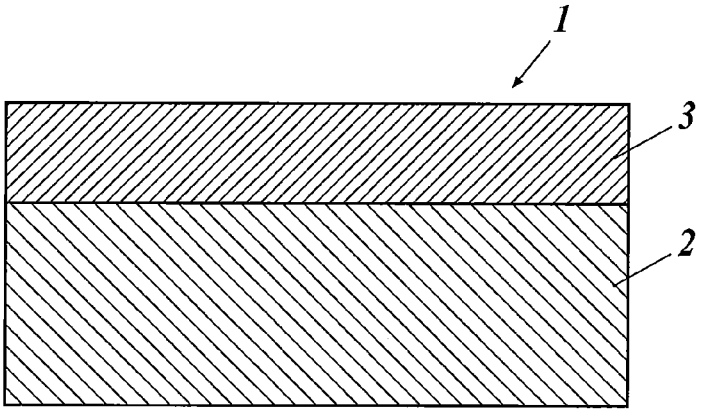
FIG. 1 is a schematic cross-sectional view of an example intermediate transfer body.

Hereinafter, one or more embodiments of the present invention will be described with reference to the drawings. However, the scope of the invention is not limited to the disclosed embodiments.

An electrophotographic image forming apparatus according to the present invention includes: a toner forcible discharger which forcibly discharges toner into a non-imaging region (where no image is formed) of an intermediate transfer body; and a controller which controls the volume of the toner to be forcibly discharged.

The intermediate transfer body is a multi-layer belt including a base layer and an outermost coating layer. The coating layer contains silicon dioxide. The controller performs control to reduce the volume of the toner to be forcibly discharged based on use history information of the intermediate transfer body, compared to the volume of the toner to be forcibly discharged at the initial stage of use of the intermediate transfer body. These technical features are common to all the aspects of the present invention.

According to an embodiment of the present invention, it is preferred that the use history information be the number of printed sheets, because the number of printed sheets can readily be correlated with the thickness of the coating layer, leading to ready control of the volume of the toner to be forcibly discharged and toner saving. It is also preferred that the use history information be an energization time of the intermediate transfer body.

According to another embodiment of the present invention, it is preferred that the use history information be the thickness of the coating layer. This configuration can more precisely control the volume of the toner to be forcibly discharged.

It is also preferred that the use history information be sliding distance information of the intermediate transfer body.

It is also preferred that the use history information reflect the environmental temperature in the vicinity of the coating layer. This configuration allows the control to reflect a difference in abrasion rate among different environmental temperatures.

An electrophotographic image forming method of forming an image from a toner image according to another embodiment of the present invention involves: primarily transferring a toner image retained by an electrostatic latent image retainer to an imaging region (where an image is formed) of an intermediate transfer body; secondarily transferring the toner image transferred in the primarily transferring from the intermediate transfer body to a transfer medium; and forcibly discharging toner into a non-imaging region of the intermediate transfer body.

The intermediate transfer body is a multi-layer belt including a base layer and an outermost coating layer. The coating layer contains silicon dioxide.

The volume of the toner to be forcibly discharged into the non-imaging region is reduced by a controller based on use history information of the intermediate transfer body, compared to the volume of the toner to be forcibly discharged at the initial stage of use of the intermediate transfer body.

It is preferred that the volume of the toner to be forcibly discharged be not reduced after an amount of use of the intermediate transfer body reaches a predetermined value in order to save toner.

It is preferred that the volume of the toner reduced at the controller be variable depending on the type of the transfer medium. This configuration can achieve sufficient secondary transfer characteristics and toner saving on various transfer media. For example, a reduction in the volume of the toner to be forcibly discharged on uneven transfer sheet may be adjusted to be larger than that on smoother transfer sheet (e.g., coated paper). Alternatively, the volume of the toner to be forcibly discharged may be reduced depending on a use of the intermediate transfer body only for uneven transfer sheet.

The present invention and its components will now be described in detail according to embodiments of the present invention. The word "to" between the lower and upper limit values indicates the range encompassing the lower and upper limit values throughout the specification.

<<Scheme of Electrophotographic Image Forming Apparatus>>

The electrophotographic image forming apparatus of the present invention includes:

an electrostatic latent image retainer;

an intermediate transfer body;

a primary transfer member to execute a primary transfer of toner image retained by the electrostatic latent image retainer to an imaging region of the intermediate transfer body;

a secondary transfer member to execute a secondary transfer of the toner image transferred in the primary transfer by the primary transfer member from the intermediate transfer body to a transfer medium;

a toner forcible discharger to forcibly discharge toner into a non-imaging region of the intermediate transfer body; and a controller to control a volume of the toner to be forcibly discharged by the toner forcible discharger.

The intermediate transfer body is a multi-layer belt including a base layer and an outermost coating layer.

The coating layer contains silicon dioxide.

The controller performs control to reduce the volume of the toner to be forcibly discharged based on use history information of the intermediate transfer body, compared to the volume of the toner to be forcibly discharged at an initial stage of use of the intermediate transfer body.

FIG. 1 is a schematic cross-sectional view of an example intermediate transfer body used in the present invention. An intermediate transfer body 1 is a multi-layer belt including a base layer 2 and an outermost coating layer 3 containing silicon dioxide. The intermediate transfer body 1 may further have any layer such as a resilient layer between the base layer 2 and the coating layer 3. The coating layer does not allow toner to tightly adhere thereto, has a small contact angle, and concentrates the introduced electric charges with a high resistance layer. This layer configuration can thus improve the durability and secondary transfer characteristics of the intermediate transfer body.

Such an intermediate transfer body, however, leads to significant degradation of transfer characteristics on uneven sheets after continuous printing. The inventors have investigated solutions to this problem as below.

Figure 2:
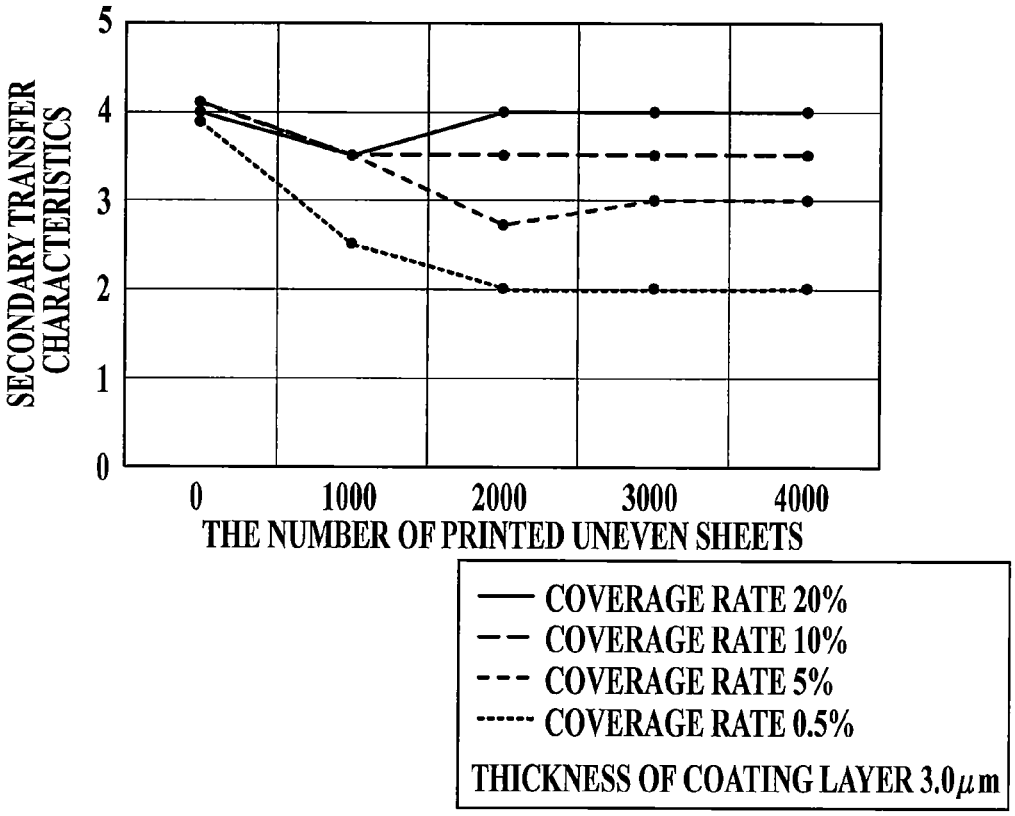
FIG. 2 illustrates example differences in secondary transfer characteristics among different coverage rates after continuous printing on uneven sheets.

FIG. 2 illustrates example differences in secondary transfer characteristics among different coverage rates after continuous printing on uneven sheets. In detail, the secondary transfer characteristics after continuous printing at coverage rates from 0.5% to 20% were evaluated, where the printing was performed in an electrographic image forming apparatus illustrated in FIG. 5 including the intermediate transfer body 1 (fabricated in Examples) having a 3.0-μm coating layer. The used uneven sheets were white LEATHAC 66 (trademark of Tokushu Tokai Paper Co., Ltd.) having a basis weight of 203 gsm. The y axis of the graph indicates the level of secondary transfer characteristics, which should be at least 3 in practical use.

FIG. 2 demonstrates that a reduction in secondary transfer characteristics after continuous printing caused by decrease in a coverage rate can be compensated for by an increase in toner consumption. As illustrated in FIG. 2, if the toner consumption per printing on one sheet is a volume corresponding to a coverage rate of 20%, a reduction in secondary transfer characteristics after continuous printing is substantially zero. In other words, the electrophotographic image forming apparatus should include a toner forcible discharger for forcibly discharging toner into the non-imaging region of the intermediate transfer body and adjust the toner consumption per one print sheet to the volume corresponding to a coverage rate of 20%. This configuration can ensure sufficient secondary transfer characteristics in despite of continuous printing.

The disadvantage of this solution is a certain toner consumption amount regardless of the coverage rate, resulting in a relatively large toner consumption amount. The inventors have discussed this disadvantage and found that a reduction in secondary transfer characteristics of the multi-layer belt having a coating layer containing silicon dioxide after continuous printing on uneven sheets differs depending on the thickness of the coating layer.

Figure 3:
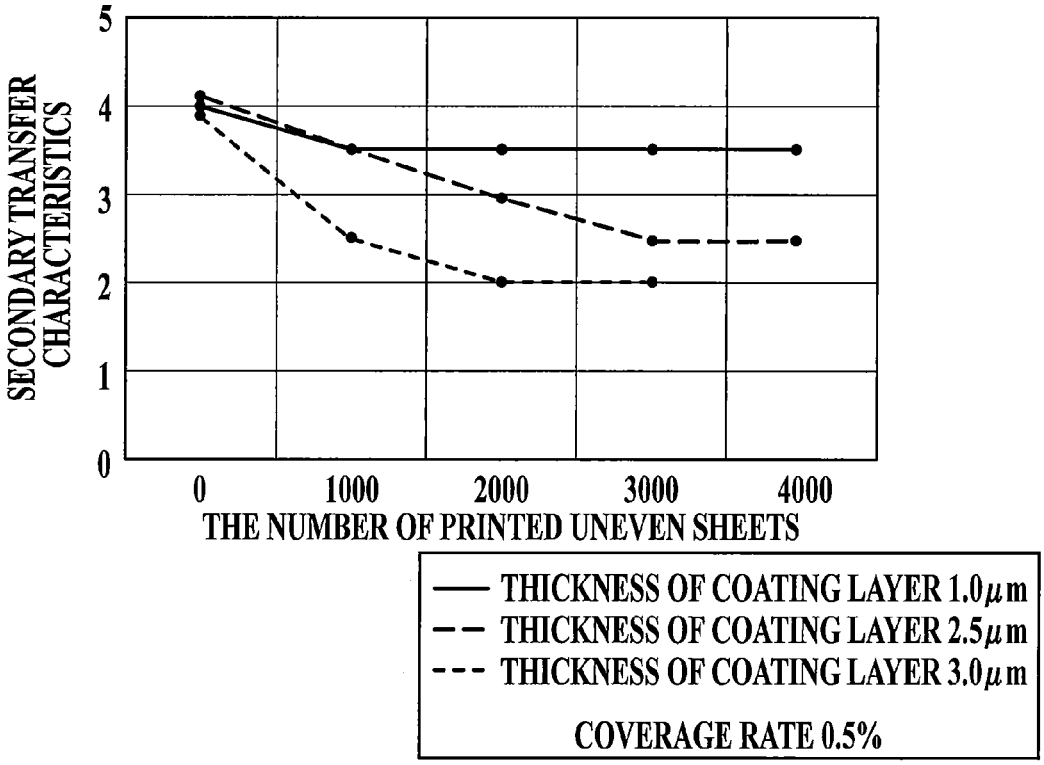
FIG. 3 illustrates example differences in secondary transfer characteristics among different thicknesses of a coating layer after continuous printing on uneven sheets.

FIG. 3 illustrates example differences in secondary transfer characteristics among different thicknesses of the coating layer after continuous printing on uneven sheets. In detail, the secondary transfer characteristics during continuous printing of 10,000 sheets at 0.5 coverage rates were evaluated for different thicknesses of the coating layer, where the printing was performed in the electrographic image forming apparatus illustrated in FIG. 5 including the intermediate transfer body (fabricated in Examples). The used uneven sheets were white LEATHAC 66 (trademark of Tokushu Tokai Paper Co., Ltd.) having a basis weight of 203 gsm.

A reduction in secondary transfer characteristics of the intermediate transfer body with the 1.0-μm coating layer after continuous printing is smaller than that with the 3.0-μm coating layer. Whereas FIG. 2 demonstrates traditional knowledge that an increase in volume of the toner to be forcibly discharged (high coverage rate setting) can prevent the secondary transfer characteristics from being degraded during continuous printing on uneven sheets, FIG. 3 demonstrates knowledge that sufficient secondary transfer characteristics can be maintained on the coating layer thinned due to abrasion in despite of a small volume of the toner to be forcibly discharged. This knowledge has been unknown hitherto and is novel.

During the use of the apparatus, the coating layer is subjected to repeated abrasion by cleaning blades, photoreceptors, paper sheets, etc. and thus is gradually worn out.

Figure 4:
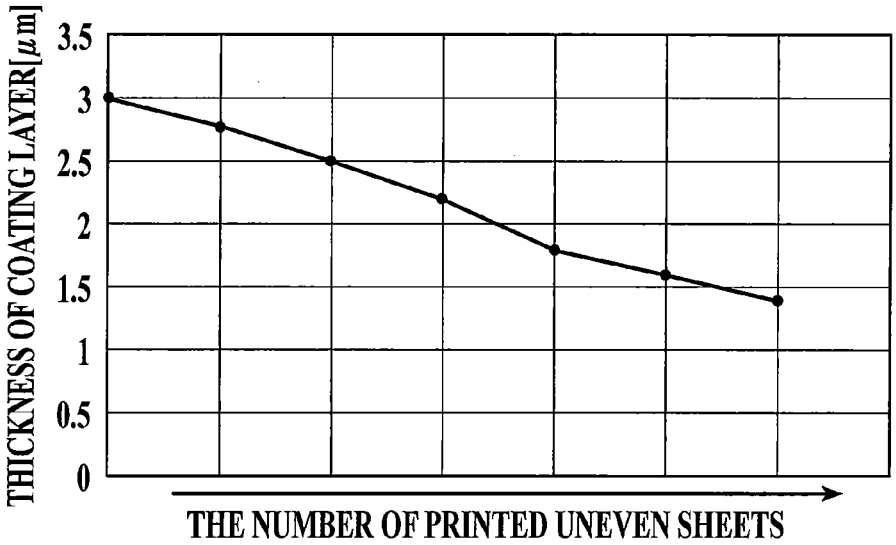
FIG. 4 illustrates an example reduction in thickness of a coating layer due to abrasion during continuous printing on uneven sheets.

FIG. 4 illustrates an example abrasion (reduction in thickness) of the coating layer due to continuous printing on uneven sheets.

The above-described results have revealed that further forcible discharge of the toner under the initial toner consumption setting while the coating layer of the intermediate transfer body is being worn away in accordance with the use leads to excessive toner consumption.

According to the present invention, a controller performs control to reduce the volume of the toner to be forcibly discharged based on the thickness of the coating layer containing silicon dioxide (i.e., based on the use history information of the intermediate transfer body), compared to the volume of the toner to be forcibly discharged at the initial stage of use of the intermediate transfer body. This configuration can achieve compatibility between stable secondary transfer characteristics and low toner consumption.

The coverage rate indicates the percentage of the total area of the toner images to the entire area of a single sheet S. In specific, a small coverage rate represents a small area of the toner images and a large area of the non-imaging region in the entire sheet S.

<<Detailed Configuration of Electrophotographic Image Forming Apparatus>>

Examples of the electrophotographic image forming apparatus, to which the intermediate transfer body according to the present invention can be applied, include apparatuses of forming monochrome electrophotographic images with a single-color toner, apparatuses of forming color electrophotographic images that sequentially transfer toner images from photoreceptors to the intermediate transfer body, and tandem-type apparatuses of forming color electrophotographic images including photoreceptors for individual colors disposed in series on the intermediate transfer body.

The intermediate transfer body according to the present invention is effectively applicable to tandem-type apparatuses of forming color images.

Figure 5:
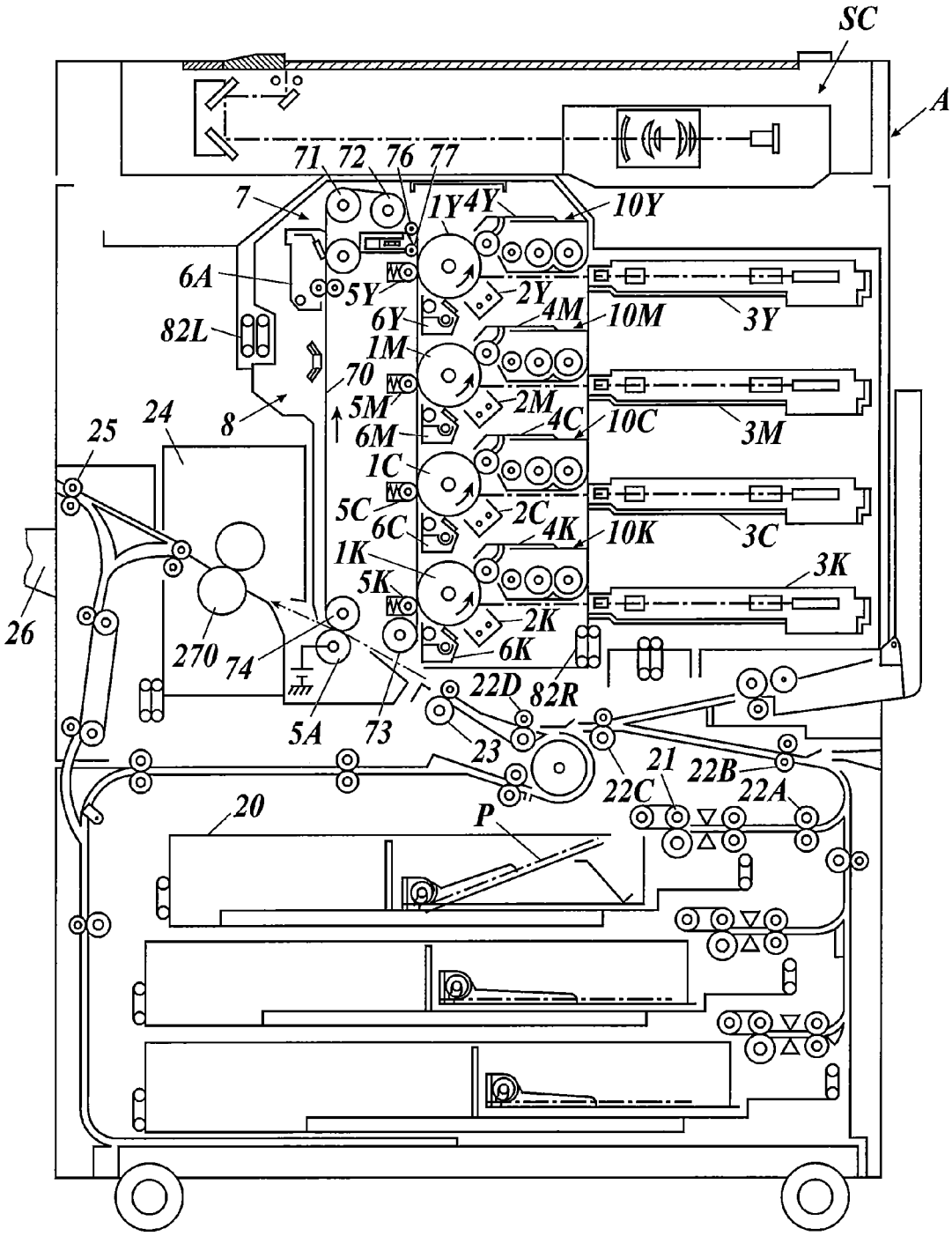
FIG. 5 is a cross-sectional view of an example electrophotographic image forming apparatus according to the present invention.

FIG. 5 is a cross-sectional view of an example electrophotographic image forming apparatus according to the present invention.

In FIG. 5, reference numerals 1Y, 1M, 1C, and 1K indicate drum-type photoreceptors (functioning as electrostatic latent image retainers); reference numerals 4Y, 4M, 4C, and 4K indicate developing members; reference numerals 5Y, 5M, 5C, and 5K indicate primary transfer rollers (functioning as primary transfer members); reference numeral 5A indicates a secondary transfer roller (functioning as a secondary transfer member); reference numerals 6Y, 6M, 6C, and 6K indicate cleaners; reference numeral 7 indicates an intermediate transfer body unit; reference numeral 24 indicates a heating roller fixing device; and reference numeral 70 indicates an intermediate transfer body.

This apparatus of forming a color electrophotographic image is of a tandem type, and includes multiple image forming units 10Y, 10M, 10C, and 10K, an endless-belt intermediate transfer body unit (transfer unit) 7, an endless-belt sheet feeder 21 for transporting a recording medium P, and a heating roller fixing device (fixing member) 24. The electrophotographic image forming apparatus includes a body A and an original image scanner SC disposed above the body A.

Toner images in different colors are formed on the respective photoreceptors. The image forming unit 10Y forms a yellow toner image. The image forming unit 10Y includes a drum-type photoreceptor 1Y as the first photoreceptor; and a charger 2Y, an exposing member 3Y, a developing member 4Y, a primary transfer roller 5Y as a primary transfer member, and a cleaner 6Y that are disposed around the drum-type photoreceptor 1Y. The image forming unit 10M forms a magenta toner image. The image forming unit 10M includes a drum-type photoreceptor 1M as the first photoreceptor; and a charger 2M, an exposing member 3M, a developing member 4M, a primary transfer roller 5M as a primary transfer member, and a cleaner 6M that are disposed around the drum-type photoreceptor 1M. The image forming unit 10C forms a cyan toner image. The image forming unit 10C includes a drum-type photoreceptor 1C as the first photoreceptor; and a charger 2C, an exposing member 3C, a developing member 4C, a primary transfer roller 5C as a primary transfer member, and a cleaner 6C that are disposed around the drum-type photoreceptor 1C. The image forming unit 10K forms a black toner image. The image forming unit 10K includes a drum-type photoreceptor 1K as the first photoreceptor; and a charger 2K, an exposing member 3K, a developing member 4K, a primary transfer roller 5K as a primary transfer member, and a cleaner 6K that are disposed around the drum-type photoreceptor 1K.

The endless-belt intermediate transfer body unit 7 includes an endless-belt intermediate transfer body (second image retainer) 70 wound around and rotatably supported by multiple rollers.

The toner images in different colors formed at the respective image forming units 10Y, 10M, 10C, and 10K are sequentially transferred onto the circulating endless-belt intermediate transfer body 70 with the primary transfer rollers 5Y, 5M, 5C, and 5K, to form a composite color image. A recording medium (transfer medium) P, such as a paper sheet, stocked in a sheet feeding cassette 20 is fed by the sheet feeder 21, and transported via multiple intermediate rollers 22A, 22B, 22C, and 22D and register rollers 23 to the gap between a secondary transfer roller 5A as a secondary transfer member and an opposite roller 74. The composite color image on the endless-belt intermediate transfer body 70 is then transferred onto the recording medium P. The color image on the recording medium P is fixed with the heating roller fixing device 24. The recording medium P is then pinched between discharging rollers 25 and is transported to a sheet receiving tray 26 outside the apparatus.

After the transfer of the color image onto the recording medium P with the secondary transfer roller 5A and the self-stripping of the recording medium P from the circulating endless-belt intermediate transfer body 70, the residual toner on the endless-belt intermediate transfer body 70 is removed by the cleaner 6A.

The primary transfer roller 5K is in pressure contact with the photoreceptor 1K all the time during the image formation. The other primary transfer rollers 5Y, 5M, and 5C come into pressure contact with the corresponding photoreceptors 1Y, 1M, and 1C only during the formation of color images.

The secondary transfer roller 5A is in pressure contact with the endless-belt intermediate transfer body 70 only while the recording medium P is passing therebetween during the second transfer.

A housing 8 can be extracted from the body A along support rails 82L and 82R.

The housing 8 accommodates the image forming units 10Y, 10M, 10C, and 10K and the endless-belt intermediate transfer body unit 7.

The image forming units 10Y, 10M, 10C, and 10K are tandemly disposed in the vertical direction. The endless-belt intermediate transfer body unit 7 is disposed on the left of the drum-type photoreceptors 1Y, 1M, 1C, and 1K in FIG.

5. The endless-belt intermediate transfer body unit 7 includes the endless-belt intermediate transfer body 70 rotatably wound around rollers 71, 72, 73, 74, and 76; the primary transfer rollers 5Y, 5M, 5C, and 5K; and the cleaner 6A.

Pulling the housing 8 out can integrally extract the image forming units 10Y, 10M, 10C, and 10K and the endless-belt intermediate transfer body unit 7 from the body A.

As described above, toner images in different colors are formed on the drum-type photoreceptors 1Y, 1M, 1C, and 1K through the charging, exposing, and developing processes, and are superimposed into a composite color image on the endless-belt intermediate transfer body 70. The composite color image is transferred onto the recording medium P, and is then fixed by heat under pressure with the heating roller fixing device 24. After the transfer of the toner images to the recording medium P, the photoreceptors 1Y, 1M, 1C, and 1K are cleaned with the respective cleaners 6Y, 6M, 6C, and 6K to remove the residual toner thereon. The operation then proceeds to the next cycle involving charging, exposing, and developing processes to form a subsequent image.

<<Toner Forcible Discharger>>

The electrophotographic image forming apparatus according to the present invention includes a toner forcible discharger to forcibly discharge toner into the non-imaging region of the intermediate transfer body, and the controller to control the volume of the toner to be forcibly discharged by the toner forcible discharger. The controller executes control to reduce the volume of the toner to be forcibly discharged based on the use history information of the intermediate transfer body, compared to the volume of the toner to be forcibly discharged at the initial stage of use of the intermediate transfer body.

In other words, in the present invention, the volume of the toner to be forcibly discharged is reduced compared to the volume of the toner to be forcibly discharged at the initial stage of use of the intermediate transfer body, based on the use history information, such as the number of printed sheets, to stabilize the secondary transfer characteristics.

In the present invention, printing on one sheet requires a toner volume equal to the sum of the toner volume used for printing and the toner volume forcibly discharged into the non-imaging region. The toner volume to be forcibly discharged is reduced based on the use history information of the intermediate transfer body, compared to the toner volume to be forcibly discharged at the initial stage of use of the intermediate transfer body.

The toner may be forcibly discharged into the non-imaging region by forcibly writing images with a writing device and applying a developer on the photoreceptors. This operation can allow the toner to be forcibly consumed.

<Controller>

Figure 6:
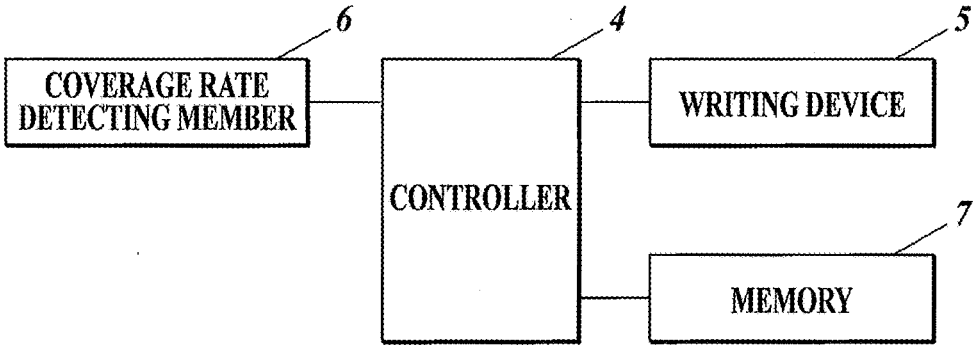
FIG. 6 is a block diagram illustrating an example configuration of a control member for forcible discharge of toner.

FIG. 6 is a block diagram illustrating an example configuration of the control member for forcible discharge of toner.

The controller 4 is composed of a microcomputer including a CPU and a memory, and is connected to at least a writing device 5, a memory 7 storing the use history information, and a coverage rate detecting member 6. The controller 4 may also be connected to, the transfer unit/device, fixing device, sheet feeding mechanism, discharging unit, input and output units, and/or a communication unit capable of communicating with external personal computers and the like. The memory of the controller 4 stores image data acquired from the external computer via the communication unit, and various control and image processing programs to be executed by the CPU.

The coverage rate of an image may be determined by any known procedure. For example, the controller 4 instructs the coverage rate detecting member 6 to determine the coverage rate of the image based on the comparison of the accumulated coverage rate (the number of pixels) of the images in a predetermined period and a predetermined coverage rate (the number of pixels).

As examples of the use history information of the intermediate transfer body in accordance with the use, the number of printed sheets, energization time of the intermediate transfer body, sliding distance information of the intermediate transfer body, thickness information of the coating layer, information on temperature in the vicinity of the coating layer, and reflectance information of the coating layer may be utilized. The use history information and other essential information required for the control are stored into the memory 7 via the corresponding input and output units. The use history information includes a correlation table of the thickness of the coating layer after abrasion associated with the use history and the level of secondary transfer characteristics.

Based on this correlation table and the coverage rate of the image, the controller 4 calculates the volume of toner to be forcibly discharged, which volume is appropriate for the image forming apparatus after the use of the intermediate transfer body, and instructs the writing device 5 to forcibly discharge the calculated volume of toner into the non-imaging region of the intermediate transfer body.

<<Details on Control Method>>

In general, a single-layer belt can maintain sufficient secondary transfer characteristics by consuming a constant volume of toner, for example, under the setting of "high coverage rate" (involving a large volume of toner to be forcibly discharged) for maintaining responsiveness (image quality), regardless a degree of use.

Meanwhile, the intermediate transfer body having the coating layer containing silicon dioxide does not need to maintain the volume of the toner to be forcibly discharged in an early period of printing, because the coating layer is gradually thinned due to abrasion in accordance with the use.

Figure 7:
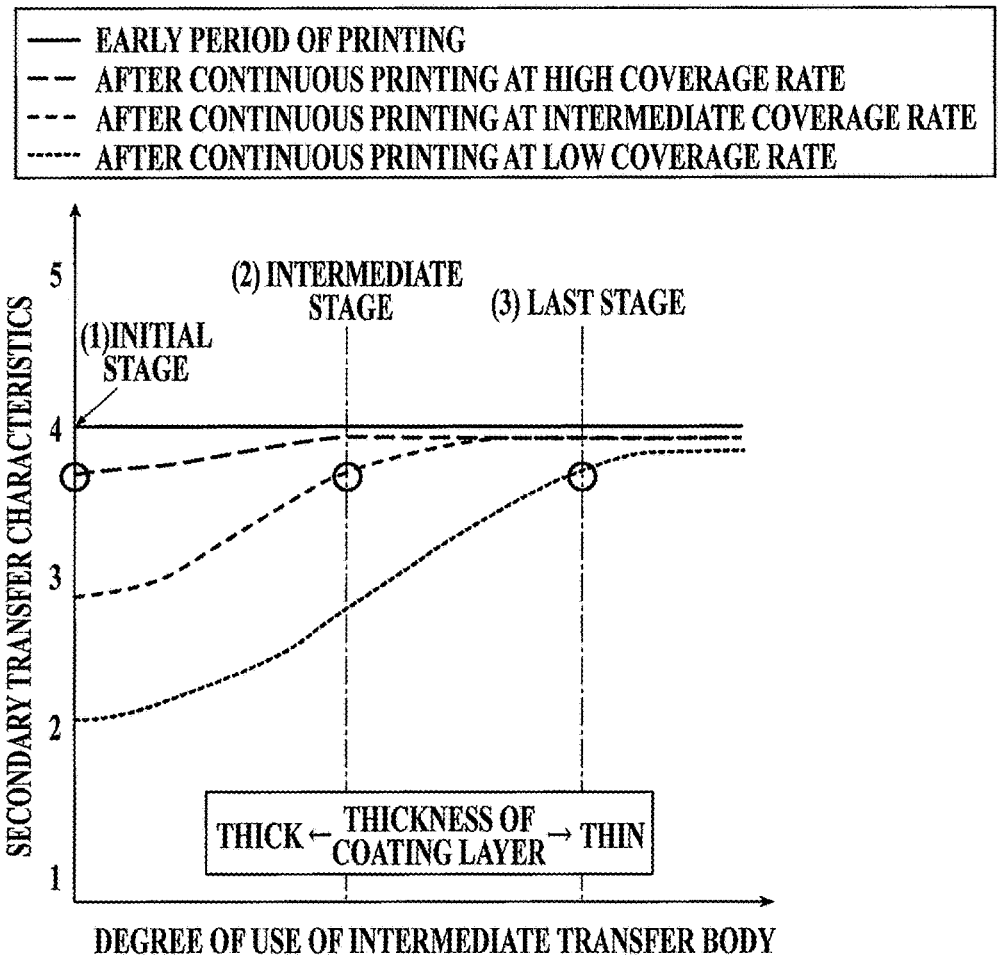
FIG. 7 is a conceptual diagram illustrating a variation in secondary transfer characteristics during continuous printing on uneven sheets.

FIG. 7 is a conceptual diagram illustrating a variation in secondary transfer characteristics during continuous printing on uneven sheets. The graph assumes an example where the intermediate transfer body having the coating layer containing silicon dioxide has a certain thickness. The x axis of the graph indicates the degree of use of the intermediate transfer body. The coating layer containing silicon dioxide is gradually thinned in accordance with the use. The graph demonstrates the following:

(1) At an initial stage of use, sufficient secondary transfer characteristics can be maintained by setting a high coverage rate to forcibly consume the toner in a constant volume even in the printing operation of an image having a low coverage rate. A printing operation at a low coverage rate that involves the forcible discharge of the toner in a small volume cannot maintain sufficient secondary transfer characteristics after continuous printing.

(2) At an intermediate stage of use, secondary transfer characteristics at a comparable level should be maintained at the intermediate coverage rate that involves the forcible discharge of the toner in a reduced volume instead of the high coverage rate, to prevent excess toner consumption. This switching of the coverage rates results from the improvement of the secondary transfer characteristics after continuous printing on uneven sheets due to the coating layer thinned in accordance with the use of the intermediate transfer body.

(3) At a late stage of use, sufficient secondary transfer characteristics can be maintained at the low coverage rate that involves the forcible discharge of the toner in a further reduced volume.

The thickness of the coating layer to be worn out in accordance with the use can be set depending on the specifications and concepts of the individual apparatus. This control can maintain the sufficient secondary transfer characteristics without excess toner consumption over the entire period of use of the intermediate transfer body.

<Use History Information of Intermediate Transfer Body>

Non-limiting examples of the use history information include the number of printed sheets, energization time of the intermediate transfer body, thickness information of the coating layer, and sliding distance information or developing drive time of the intermediate transfer belt. The use history information may also be any parameter associated with a variation in the intermediate transfer body in use of the electrophotographic image forming apparatus. The use history information of the intermediate transfer body is used in the estimation of the abrasion level of the coating layer, to reduce the volume of the toner to be forcibly discharged into the non-imaging region, compared to the volume of the toner to be forcibly discharged at the initial stage of use of the intermediate transfer body.

The number of printed sheets indicates an accumulated number of printed sheets from the start of use of the intermediate transfer body.

The energization time of the intermediate transfer body indicates the accumulated time of feeding power via the transfer drums to the intermediate transfer body from the start of use.

The information on the thickness of the coating layer can be determined, for example, based on the reflectance of the coating layer measured with a sensor having a certain wavelength. This technique can estimate the thickness of the coating layer based on a difference in spectral reflectance among different thicknesses of the coating layer. Such determination of the relation between the thickness and the reflectance of the coating layer can estimate the thickness of the coating layer after abrasion.

Figure 8:
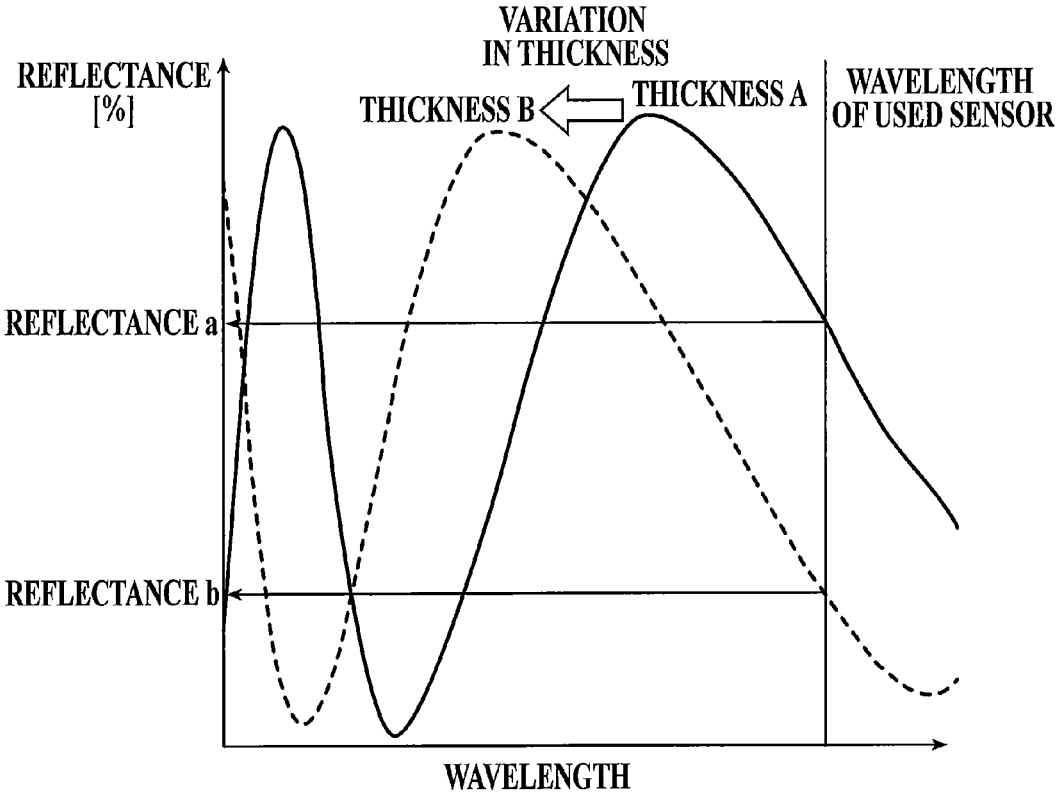
FIG. 8 is a conceptual diagram illustrating the measurement of the thickness of a coating layer based on its reflectance.
Figure 9:
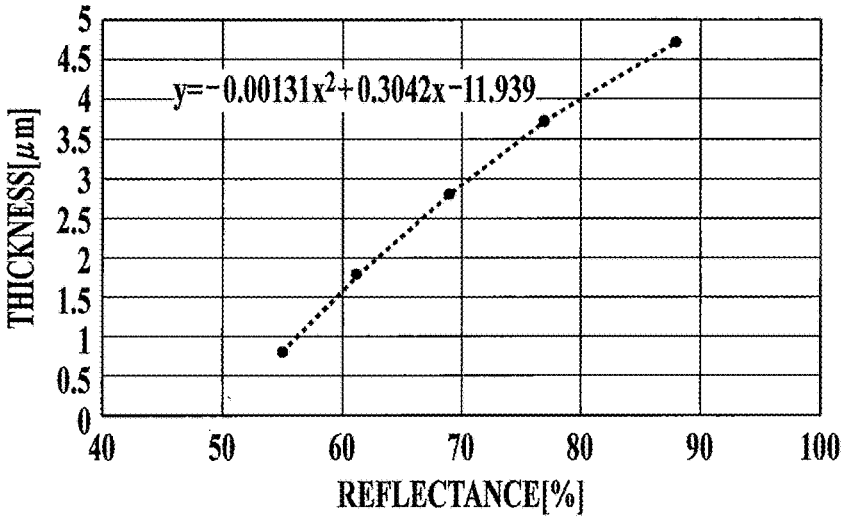
FIG. 9 illustrates an example relation between the reflectance of a coating layer and the thickness of the coating layer.

FIG. 8 is a conceptual diagram illustrating the measurement of the thickness of the coating layer based on its reflectance. FIG. 9 illustrates an example relation between the reflectance and the thickness of the coating layer. If the reflectance of the surface of the coating layer measured with the sensor is 70%, the thickness of the coating layer calculated based on the approximate expression in FIG. 9 is 2.9 μm. The example relation between the thickness of the coating layer and the required toner volume (coverage rate) illustrated in FIG. 12 (described below), for example, represents that sufficient secondary transfer characteristics can be achieved at a toner consumption corresponding to a coverage rate of 4.0%.

The use history information of the intermediate transfer body may also be the sliding distance information of the intermediate transfer body from the start of use. In this case, the volume of the toner to be forcibly discharged can be gradually reduced based on, for example, the predetermined correlation table of the thickness of the coating layer varying with the sliding distance and a toner volume required for maintaining the sufficient secondary transfer characteristics on the coating layer having this thickness. This correlation table can be stored in the memory 7.

The abrasion level of the intermediate transfer body varies depending on the environmental temperature; hence, it is preferred that the use history information reflect the environmental temperature in the vicinity of the coating layer.

In another embodiment, the volume of the toner to be forcibly discharged is not reduced after the amount of use of the intermediate transfer body reaches a predetermined value. This control can reduce the loads on the controller 4.

It is preferred that the controller 4 further reduce the volume of the toner to be forcibly discharged depending on the type of the transfer medium. This control can bring about advantageous effects especially in a printing on uneven sheets, resulting in higher toner saving. It is thus preferred that the volume of the toner to be forcibly discharged be variable depending on the type of the transfer medium.

This control of the toner volume based on the use history information of the intermediate transfer body affecting the thickness of the coating layer may be executed all the time, at the start of each job, at the activation of the electrophotographic image forming apparatus in the morning, or at intervals of a predetermined number of printed sheets.

<<Intermediate Transfer Body>>

The intermediate transfer body according to the present invention is a multi-layer belt including a base layer and a coating layer containing silicon dioxide at the outermost surface. The intermediate transfer body may also include any other layer, such as a resilient layer between the base layer and the coating layer, as required.

<Base Layer>

The base layer has a shape of a seamless belt, cylindrical drum, or roller and is composed of a resin containing a dispersed electrically conductive material, for example. The base layer in the present invention can be fabricated with any known material by any known process.

Examples of the known material include resins such as polycarbonates, polyphenylene sulfide, polyvinylidene fluoride, polyimides, polyethers, and ether ketones, and resins consisting mainly of polyphenylene sulfide. Polyimides are preferred to provide high electrical conductivity and durability.

Examples of the known fabrication process include the application of a solution prepared by dissolving a resin in a solvent and the direct formation of a resin film. The direct formation of a resin film is preferred.

Examples of the direct formation of a resin film to fabricate the base layer include extrusion molding and inflation molding. In either case, a resin material and various electrically conductive materials are fused and kneaded. In the extrusion molding, the resulting resin mixture is extruded and then cooled into an endless belt. In the inflation molding, the melted resin is shaped into a cylinder in a mold, air is injected into the mold from a blower, and then the resin is cooled into an endless belt.

A typical example of the electrically conductive material is carbon black, in particular, neutral carbon black. The amount of the electrically conductive material can be adjusted depending on its type such that the volume resistance and surface resistance of the intermediate transfer body fall within predetermined ranges.

The base layer may also contain any additive, such as a lubricant, as required.

<Coating Layer>

The coating layer contains silicon dioxide. The coating layer may be any layer containing silicon dioxide. The thickness of the coating layer should preferably range from 500 to 7,000 nm, to achieve appropriate durability, surface strength, adhesion to the resin layer, bending durability, and deposition time. The thickness should more preferably range from 800 to 6,000 nm.

The coating layer may include two or more sublayers. In the coating layer including two sublayers, the thickness of the upper sublayer should preferably range from 600 to 6,000 nm, whereas the thickness of the lower sublayer should preferably range from 900 to 5,000 nm. This layer configuration can further enhance the durability.

The thickness of the coating layer can be measured with a thickness gauge "MXP 21" (manufactured by Mac Science Co., Ltd.) by the following procedure. The MXP 21 is operated under 42 kV and 500 mA using a copper target as an X-ray source. The incident monochromator used is a multilayer parabola mirror. The size of the entrance slit is 0.05 mm×5 mm, whereas the size of the receiving slit is 0.03 mm×20 mm. The measurement is executed by the FT process in the 2θ/θ scanning mode from 0° to 5° with a step of 0.005° at a rate of 10 seconds per step. The acquired curve of reflectance is subjected to a curve fitting process using the Reflectivity Analysis Program Ver. 1 developed by Mac Science Co., Ltd., to determine parameters that minimize the residual sum of squares between the measured value and the fitting curve. The resulting parameters are used to calculate the thickness of the laminated film.

The silicon dioxide content in the coating layer should preferably be at least 5% by mass. The content should more preferably range from 50% to 80% by mass. The content should preferably be at most 80% by mass to prevent cracking of the coating layer.

The coating layer can be fabricated by any procedure, such as spattering, vacuum deposition, physical vapor deposition (PVD) (e.g., ion plating), chemical vapor deposition (CVD), plasma enhanced CVD, atmospheric pressure plasma enhanced CVD, or coating.

The coating is most preferred among these examples because it can readily fabricate a film including sublayers or a thick film. The coating may be any known technique, such as spin coating, roller coating, spray coating, or dip coating.

Examples of the known coating technique include application of a coating solution prepared by hydrolysis of a mixture of colloidal silica, organosilane, and a solvent onto the intermediate transfer body and then drying the belt for a predetermined time at a high temperature to evaporate the solvent; application of a polysilazane solution onto the intermediate transfer body and then treating the belt in an oxidizing atmosphere; and application of a solution containing a three-dimensional cross-linked resin and silica particles onto the intermediate transfer body and curing the resin by UV ray emission.

The colloidal silica used as silicon dioxide is in the form of aggregates of fine particles having a primary particle size ranging from 0.005 to 0.1 μm. In a normal state, hundreds to thousands of particles having such a primary particle size aggregate and exist in the form of secondary particles.

<Resistance of Intermediate Transfer Body>

The volume resistance of the intermediate transfer body should preferably range from $1\times10^{6}$ to $1\times10^{12}$ Ωcm. The volume resistance in this range can maintain the high transfer efficiency.

<<Transfer Medium>>

The transfer medium used in the present invention is a support for retaining a toner image and is generally called an image support medium, transfer medium, or transfer sheet. Specific examples of the transfer medium include plain paper (from thin to thick paper), print paper subjected to coating such as art paper and coated paper, commercially available Japanese paper, postcard paper, plastic films for OHPs, and fabric. In particular, the present invention can be effectively applied to sheets having protrusions and recesses formed by an embossing process on their surfaces and having a basis weight from 150 to 300 gsm. A specific example of the transfer medium is LEATHAC 66 (trademark of Tokushu Tokai Paper Co., Ltd.).

EXAMPLES

Examples of the present invention will now be described but should not be construed to limit the present invention. The units "part" and "%" recited in Examples indicate "part by mass" and "% by mass," respectively, unless otherwise stated.

<<Fabrication of Intermediate Transfer Body 1>>

Intermediate transfer body 1 was fabricated having a configuration illustrated in FIG. 1.

<Base Layer>

A polyimide (PI) seamless belt having a thickness of 65 μm and containing an electrically conductive material was prepared as Base Layer 1 having a shape of an endless belt.

<Coating Layer>

Thirty parts of colloidal silica (having an average particle size of 15 μm, manufactured by Nippon Aerosil Co., Ltd.) were gradually added to a flask equipped with a stirrer and a heater and containing 70 parts of ethanol. The resulting mixture was sufficiently stirred until colloidal silica was thoroughly immersed and dispersed in ethanol. The mixture was then supplied with 12 parts of pure water and 70 parts of methyl trimethoxysilane and stirred at a temperature from 60° C. to 70° C. to cause partial hydrolysis. The resulting coating solution had a solid content of 75 parts after removal of its solvent.

The coating solution was applied onto the polyimide (PI) with a bar coater into a thickness of 3.0 μm in a dried state, and the solvent was removed by evaporation. The resulting coating layer had a surface resistance of 11.0 Log Ω/sq.

<<Fabrication of Intermediate Transfer Bodies 2 to 11>>

Intermediate Transfer Bodies 2 to 11 including coating layers having different thicknesses were fabricated as in Intermediate transfer body 1, where the amount of the coating solution applied to the polyimide was determined to adjust the thickness of the dried coating layer to 0 μm, 0.2 μm, 0.4 μm, 1.0 μm, 2.0 μm, 2.5 μm, 4.0 μm, 5.0 μm, 6.0 μm, and 6.5 μm, respectively.

[Difference in Secondary Transfer Characteristics Among Different Coverage Rates and Different Thicknesses of Coating Layer in Continuous Printing]

The secondary transfer characteristics of the fabricated intermediate transfer bodies including the coating layers having different thicknesses were evaluated after continuous printing of images having a coverage rate from 0.5% to 30% on uneven sheets in the electrophotographic image forming apparatus illustrated in FIG. 5. The specifications of the apparatus are illustrated in Table 1. The used uneven sheets were white LEATHAC 66 (trademark of Tokushu Tokai Paper Co., Ltd.) having a basis weight of 203 gsm. The number of sheets to be continuously printed was 10,000.

TABLE 1

| ELECTROPHOTOGRAPHIC IMAGE FORMING APPARATUS | | | FULL-COLOR APPARATUS EQUIPPED WITH INTERMEDIATE TRANSFER BODY |
|---|---|---|---|
| INTERMEDIATE TRANSFER BODY | | BASE LAYER | SEMICONDUCTIVE POLYIMIDE BELT |
| | | COATING LAYER | COATING LAYER COMPOSED MAINLY OF $SiO_2$ |
| | | SHAPE | ϕ 340 mm, BASE LAYER 65 μm/COATING LAYER 3.0 μm |
| | | RESISTANCE | 11.0LogΩ/sq |
| SECONDARY TRANSFER UNIT | OPPOSITE ROLLER | MATERIAL | NBR |
| | | SHAPE | ϕ 38 mm STRAIGHT |
| | | PHYSICAL PROPERTIES | Asker-C 71°, 7.5LogΩ |
| | SECONDARY TRANSFER ROLLER | MATERIAL | NBR |
| | | SHAPE | ϕ 38 mm STRAIGHT |
| | | PHYSICAL PROPERTIES | Asker-C 71°, 7.5LogΩ |
| URGING FORCE | | | 80 N |
| MINIMUM DIAMETER OF ROLLERS FOR CIRCULATING BELT | | | ϕ 18 mm NIP ROLLER |
| PROCESSING RATE | | | 400 mm/sec |
| MINIMUM DISTANCE BETWEEN IMAGES (ON A4-SIZE SHEETS) | | | 60 mm(IMAGABLE 50 mm) |
| MAXIMUM COVERAGE RATE ACHIEVED BY FORCIBLE DISCHARGE OF TONER TO MARGINS BETWEEN IMAGES | | | 25% |

<Evaluation of Secondary Transfer Characteristics>

In order to confirm the advantageous effects of the electrophotographic image forming apparatus (illustrated in FIG. 5) according to the embodiment, the frequency of color omission (white patches) in a test image printed on a sheet was evaluated. The sheet used was white LEATHAC 66 (trademark of Tokushu Tokai Paper Co., Ltd.) having a basis weight of 203 gsm, which has leather-like patterns thereon including protrusions and recesses and has relatively low surface smoothness.

The secondary transfer characteristics were visually observed with reference to boundary samples ranked from Level 0 to 5 depending on the frequency of white patches at the recesses (filling degree of toner at the recesses). The secondary transfer characteristics should be at least Level 3 in practical use.

Level of Secondary Transfer Characteristics

Figure 10:
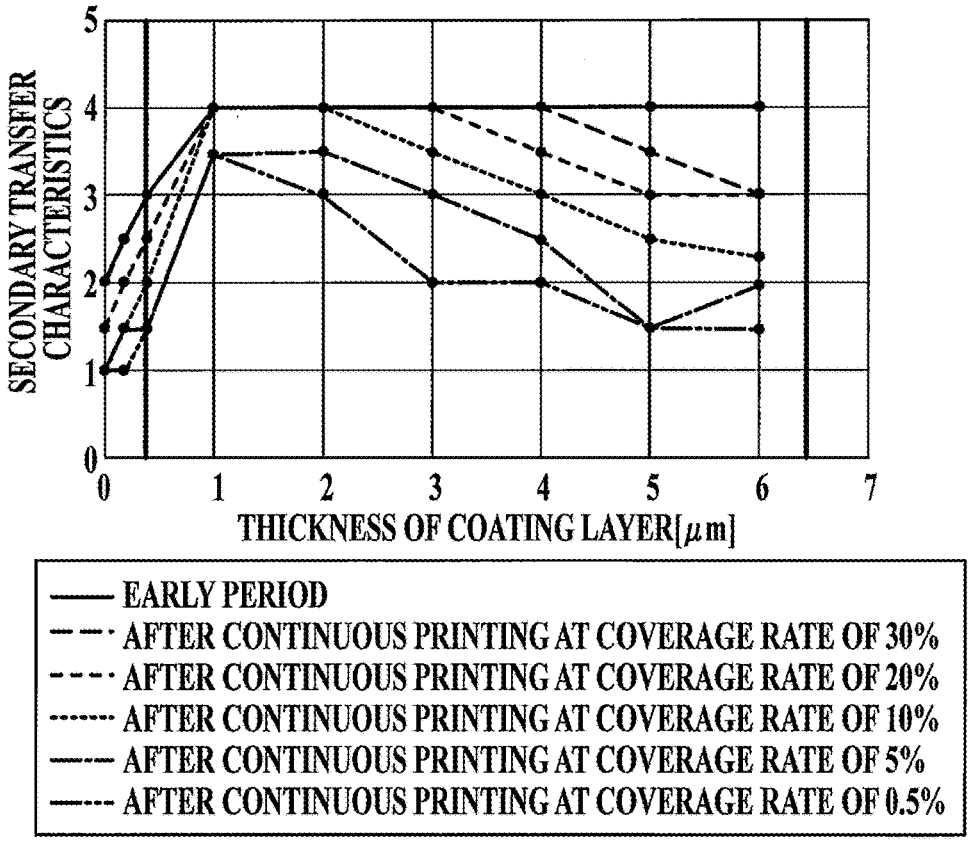
FIG. 10 illustrates example differences in secondary transfer characteristics among different thicknesses of a coating layer after continuous printing.

5: Most recesses well filled
4: Slightly low toner concentration
3: Some recesses unfilled
2: Many recesses unfilled
1: Little toner fixed
0: No toner fixed FIG. 10 illustrates example differences in secondary transfer characteristics among different thicknesses of the coating layer after continuous printing at various coverage rates. In the apparatus equipped with the intermediate transfer body including a 6.5-μm coating layer, the continuous printing caused cracking of the coating layer. In order to achieve at least Level 3 of secondary transfer characteristics specified in the concept of the apparatus, the thickness of the coating layer should preferably range from 0.5 to 6.0 μm under these conditions.

For example, for the 5.0-μm coating layer, at least Level 3 of secondary transfer characteristics can be ensured by the toner consumption corresponding to a coverage rate of 20% regardless of the use history information of the intermediate transfer body. For the 3.0-μm coating layer after abrasion in accordance with the use of the intermediate transfer body, Level 3 of secondary transfer characteristics can be ensured by the toner consumption corresponding to a coverage rate of 5%.

This process of determining the specifications of the coating layer is a mere example, and the thickness of the coating layer and the volume of the toner to be forcibly discharged into the non-imaging region can be determined depending on the concepts of the individual apparatus.

Figure 11:
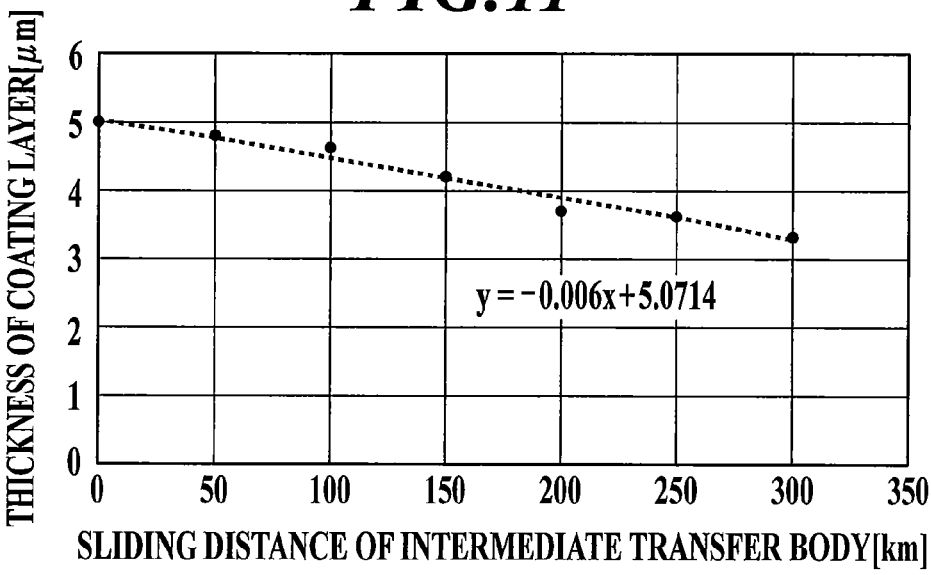
FIG. 11 illustrates a variation in thickness of a coating layer depending on a sliding distance of an intermediate transfer body.
Figure 12:
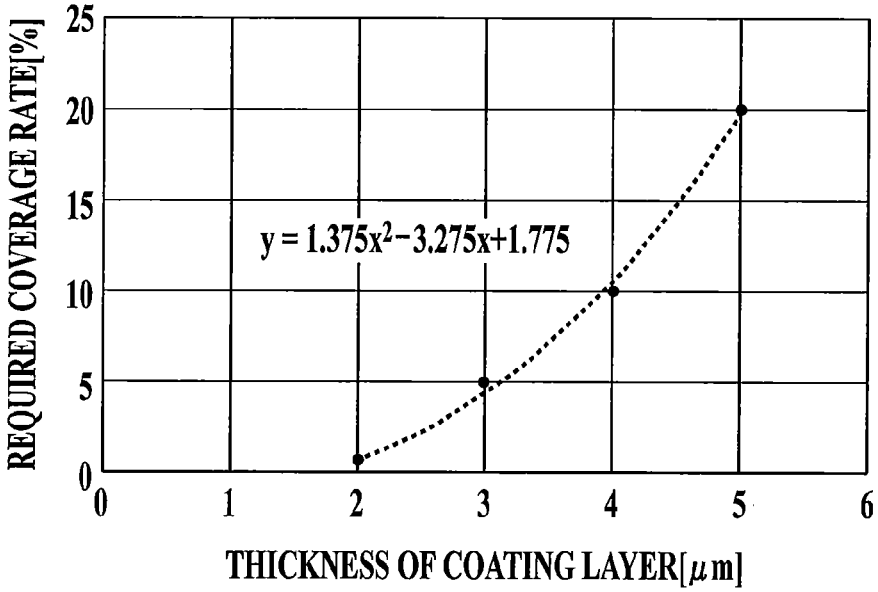
FIG. 12 illustrates an example relation between the thickness of a coating layer and the required toner volume.

A variation in thickness of the coating layer depending on the sliding distance of the intermediate transfer body was evaluated at a coverage rate of 10% on uneven sheets at an environmental temperature of 20° C. The results of the evaluation are illustrated in FIG. 11. FIG. 12 illustrates a graph of the relation between the thickness of the coating layer and the coverage rate that ensures at least Level 3 of secondary transfer characteristics, based on the results in FIG. 10.

FIG. 12 illustrates a difference in coverage rate, corresponding to the required toner volume, among different thicknesses of the coating layer.

At a sliding distance of 0 km of the intermediate transfer body, the toner consumption is adjusted (by forcible discharge) to achieve the total 20% coverage rate of the imaging regions and the margins (non-imaging regions) between the imaging regions. For example, when the sliding distance of the intermediate transfer body reaches 100 km in accordance with the use, the corresponding thickness of the coating layer is determined to be 4.4 μm based on the approximate straight line in FIG. 11, and the required coverage rate is determined to be 14% based on the approximate curve in FIG. 12; hence, the toner should be consumed to achieve the coverage rate of 14%. As described above, based on the sliding distance information (use history information) of the intermediate transfer body, the volume of the toner to be forcibly discharged is reduced from the volume corresponding to a coverage rate of 20% at the initial stage of use of the intermediate transfer body to the volume corresponding to a coverage rate of 14%. This control can achieve compatibility between stable secondary transfer characteristics and low toner consumption. The relations between the thicknesses of the coating layer and the required coverage rates may be stored in the memory 7 in advance. In this case, the required coverage rate can be read from the memory 7 depending on the thickness of the coating layer.

In contrast, on relatively smooth paper (hereinafter referred to as "plain paper"), such as coated paper, the toner consumption is adjusted (by forcible discharge) to achieve the total 10% coverage rate of the imaging regions and the margins (non-imaging regions) between the imaging regions at a sliding distance of 0 km of the intermediate transfer body. The difference in toner consumption results from the transfer characteristics of the plain paper superior to those of the uneven sheets. When the sliding distance of the intermediate transfer body becomes 100 km in accordance with the use (with the 4.4-μm coating layer), the required coverage rate becomes approximately 8%. That is, a reduction in volume of the toner to be forcibly discharged on the uneven sheets depending on the degree of use of the intermediate transfer body should be larger than that on the plain paper. In other words, the control of reducing the volume of the toner to be forcibly discharged based on the use history information of the intermediate transfer body is more effective on the uneven sheets (transfer sheet).

Alternatively, the volume of the toner to be forcibly discharged may be reduced only on the uneven sheets (transfer sheet) depending on the degree of use of the intermediate transfer body. In other words, the volume of the toner to be forcibly discharged may be kept constant (e.g., the volume corresponding to a coverage rate of 10%) on the plain paper (transfer sheet) regardless of the use history information of the intermediate transfer body.

The toner can be forcibly discharged by any known scheme, such as a scheme disclosed in Patent Literature 5. Although the volume of the toner to be discharged into the imaging regions and the margins (non-imaging regions) between the imaging regions is gradually changed in the embodiment, it may also be reduced stepwise depending on the sliding distance of the intermediate transfer body.

This example calculation assumes a stepwise variation in environmental temperature. Alternatively, the inclination of the expression may be calculated based on the detected temperature to gradually vary the temperature.

Our past investigations have revealed that some materials of the coating layer result in a decrease in level of secondary transfer characteristics only at the initial stage of use of the intermediate transfer body and then a stable level regardless of the thickness of the coating layer. If such a material is selected, the volume of the toner to be forcibly discharged should be reduced until the number of printed sheets reaches a predetermined value.

For example, with the coating material having a $SiO_2$ content adjusted to increase the hardness, the continuous printing at a coverage rate 0.5% on uneven sheets yielded the results illustrated in Table 2 below. As illustrated in Table 2, the secondary transfer characteristics significantly fall at the initial stage of use of the intermediate transfer body. That is, if the control for reducing the volume of the toner to be forcibly discharged cannot allow for any reduction in level of secondary transfer characteristics, the control should be executed until the number of printed sheets reaches 60,000 and not executed after that.

If the control can allow for a single level reduction in secondary transfer characteristics from the early period of printing, the control should be executed until the number of printed sheet reaches 40,000. The number of printed sheets used as the use history information of the intermediate transfer body may be replaced with the sliding distance information or the energization time of the intermediate transfer body.

TABLE 2

| | THE NUMBER OF PRINTED SHEETS | | | | | | |
|---|---|---|---|---|---|---|---|
| | 10000 | 20000 | 30000 | 40000 | 50000 | 60000 | 70000 |
| REDUCTION IN LEVEL OF TRANSFER CHARACTERISTICS | 2 | 1.5 | 1 | 1 | 0.5 | 0 | 0 |

The sliding distance of the intermediate transfer body is used as the use history information in the embodiment, but may be replaced with counting of the number of printed sheets or the energization time of the intermediate transfer body.

The use history information of the intermediate transfer body may be any other parameter that varies in accordance with the use of the apparatus.

Figure 13:
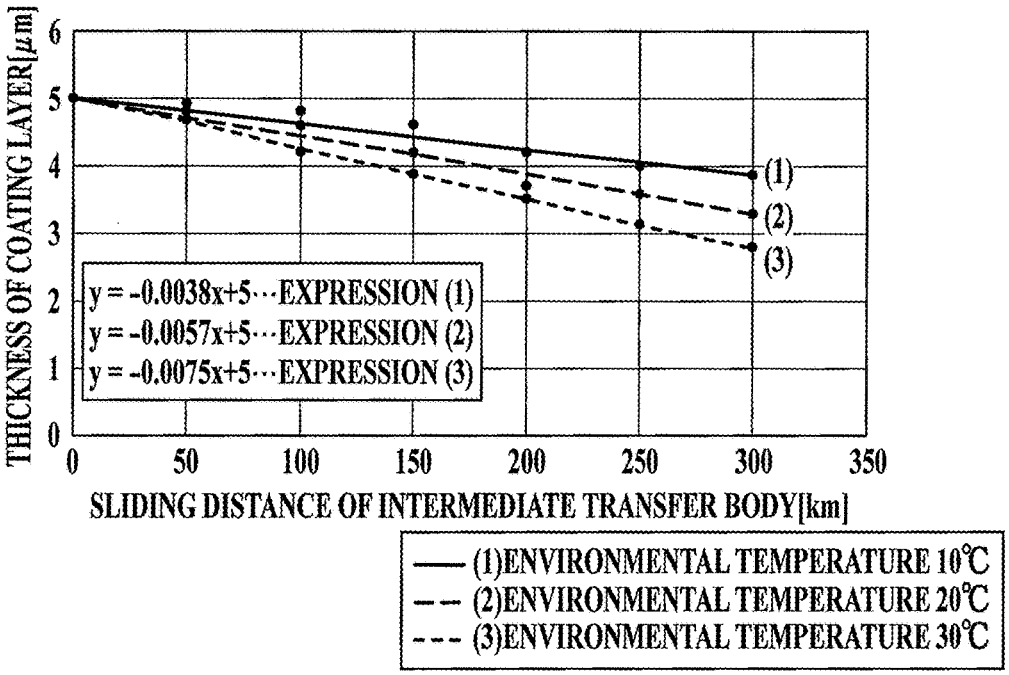
FIG. 13 illustrates example dependence of the thickness of a coating layer on temperature.
Figure 14:
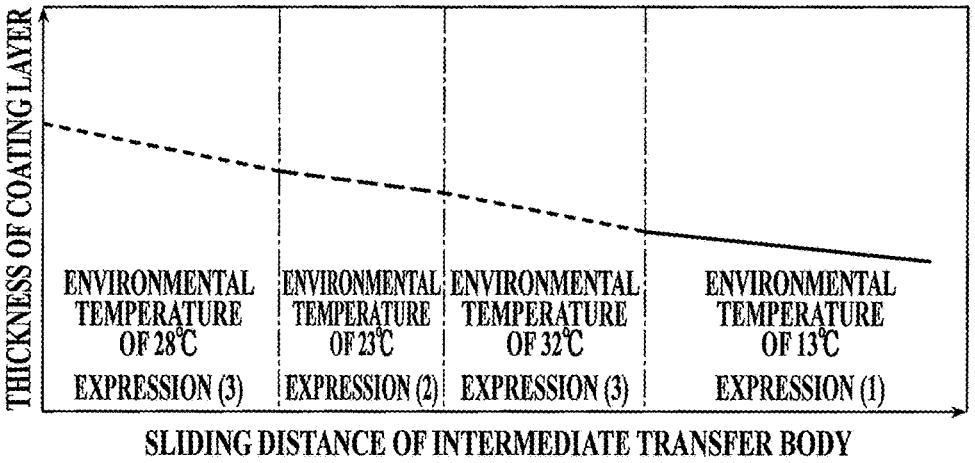
FIG. 14 illustrates another example dependence of the thickness of a coating layer on temperature.

FIG. 13 illustrates example dependence of the thickness of the coating layer on temperature. FIG. 13 demonstrates the results at environmental temperatures of 10° C. and 30° C. in addition to the results at 20° C. illustrated in FIG. 11. FIG. 14 illustrates another example dependence of the thickness of the coating layer on temperature.

If the coating layer is composed of some materials, the rate of decrease of the thickness of the coating layer varies depending on the environmental temperature. In this case, the relations illustrated in the above-mentioned graphs should be preliminarily acquired through the experiments. For example, as illustrated in FIG. 14, the thickness of the coating layer is calculated based on Expression (1) in FIG. 13 at a temperature below 15° C., Expression (2) at a temperature equal to or higher than 15° C. and below 25° C., and Expression (3) at a temperature equal to or higher than 25° C. The Expressions (1) to (3) determined in advance can be stored in the memory 7.

Our past investigations have revealed that a reduction in level of the secondary transfer characteristics is not problematic if the number of A4-size printed sheets reaches or exceeds the range of 30,000 to 200,000. This range corresponds to the range of energization time of the intermediate transfer body approximately from 4 to 30 hours.

This range corresponds to the range of energization time from 13 to 100 seconds per unit length (1 mm) of the intermediate transfer body, because the intermediate transfer body according to the embodiment has a diameter of 340 mm and a circumference of 1066 mm. The volume of the toner to be forcibly discharged should be reduced until the above range and not reduced thereafter.

In detail, the energization time or sliding distance information of the intermediate transfer body corresponding to the number of A4-size printed sheets ranging from 30,000 to 200,000 is used as the use history information of the intermediate transfer body. The volume of the toner to be forcibly discharged is adjusted to correspond to a coverage rate of 20% in the early period of printing, for example. The volume of the toner to be forcibly discharged is reduced compared to the volume of the toner to be forcibly discharged at the initial stage of use until this range of use history information. After the use history information exceeds this range, the sufficient secondary transfer characteristics can be achieved without the control of reducing the volume of the toner to be forcibly discharged.

The toner images formed for forcible discharge of toner (not for printing) onto the margins between the imaging regions in the embodiments may also be formed onto the margins on both sides of the imaging regions in the width direction of the intermediate transfer body, if the belt is considerably wide.

The above means of the present invention can provide an electrophotographic image forming apparatus that has stable secondary transfer characteristics with low toner consumption, and provide an electrophotographic image forming method that can achieve these characteristics.

Although these advantageous effects of the present invention are brought about by some unknown mechanism or operation, this may be explained as below.

The coating layer containing silicon dioxide has a high resistance and thus gradually accumulates electric charges therein during continuous printing. The accumulated electric charges probably disturb the electric fields for transfer, to thereby impair the transfer characteristics. In detail, a thick coating layer accumulates a large amount of electric charges therein and thus causes a significant reduction in transfer characteristics, whereas a thin coating layer accumulates a small amount of electric charges therein and thus causes a slight reduction in transfer characteristics.

Although embodiments of the present invention have been described and illustrated in detail, it is clearly understood that the same is by way of illustration and example only and not limitation, the scope of the present invention should be interpreted by terms of the appended claims.

What is claimed is:

1. An electrophotographic image forming apparatus comprising:

an electrostatic latent image retainer;

an intermediate transfer body;

a primary transfer member to execute a primary transfer of toner image retained by the electrostatic latent image retainer to an imaging region of the intermediate transfer body;

a secondary transfer member to execute a secondary transfer of the toner image transferred in the primary transfer by the primary transfer member from the intermediate transfer body to a transfer medium;

a toner forcible discharger to forcibly discharge toner into a non-imaging region of the intermediate transfer body; and a controller to control a volume of the toner to be forcibly discharged by the toner forcible discharger, wherein the intermediate transfer body is a multi-layer belt including a base layer and an outermost coating layer, the coating layer contains silicon dioxide, and the controller performs control to reduce the volume of the toner to be forcibly discharged based on use history information of the intermediate transfer body, compared to the volume of the toner to be forcibly discharged at an initial stage of use of the intermediate transfer body.

2. The electrophotographic image forming apparatus of claim 1, wherein the use history information is a number of printed sheets.

3. The electrophotographic image forming apparatus of claim 1, wherein the use history information is an energization time of the intermediate transfer body.

4. The electrophotographic image forming apparatus of claim 1, wherein the use history information is thickness information of the coating layer.

5. The electrophotographic image forming apparatus of claim 4, wherein the use history information reflects an environmental temperature in the vicinity of the coating layer.

6. The electrophotographic image forming apparatus of claim 1, wherein the use history information is sliding distance information of the intermediate transfer body.

7. A method for forming an electrophotographic image from a toner image, the method comprising:

primarily transferring the toner image retained by an electrostatic latent image retainer to an imaging region of an intermediate transfer body;

secondarily transferring the toner image transferred in the primarily transferring from the intermediate transfer body to a transfer medium; and forcibly discharging toner into a non-imaging region of the intermediate transfer body, wherein the intermediate transfer body is a multi-layer belt including a base layer and an outermost coating layer, the coating layer contains silicon dioxide, and a volume of the toner to be forcibly discharged into the non-imaging region is reduced by a controller based on use history information of the intermediate transfer body, compared to the volume of the toner to be forcibly discharged at an initial stage of use of the intermediate transfer body.

8. The electrophotographic image forming method of claim 7, wherein the volume of the toner to be forcibly discharged is not reduced after an amount of use of the intermediate transfer body reaches a predetermined value.

9. The electrophotographic image forming method of claim 7, wherein the volume of the toner reduced by the controller is changed depending on a type of the transfer medium.

* * * * *